US012024764B2

(12) United States Patent
Karuishi

(10) Patent No.: US 12,024,764 B2
(45) Date of Patent: Jul. 2, 2024

(54) METHOD FOR MANUFACTURING GOLDEN MEMBER AND GOLDEN MEMBER

(71) Applicant: CITIZEN WATCH CO., LTD., Tokyo (JP)

(72) Inventor: Kenya Karuishi, Tokyo (JP)

(73) Assignee: CITIZEN WATCH CO., LTD., Tokyo (JP)

( * ) Notice: Subject to any disclaimer, the term of this patent is extended or adjusted under 35 U.S.C. 154(b) by 652 days.

(21) Appl. No.: 17/251,303

(22) PCT Filed: Apr. 25, 2019

(86) PCT No.: PCT/JP2019/017754
§ 371 (c)(1),
(2) Date: Dec. 11, 2020

(87) PCT Pub. No.: WO2020/012760
PCT Pub. Date: Jan. 16, 2020

(65) Prior Publication Data

US 2021/0254204 A1 Aug. 19, 2021

(30) Foreign Application Priority Data

Jul. 11, 2018 (JP) ..... 2018-131394

(51) Int. Cl.
*C22F 1/02* (2006.01)
*C22F 1/18* (2006.01)
*C23C 8/34* (2006.01)

(52) U.S. Cl.
CPC ..... *C22F 1/02* (2013.01); *C22F 1/183* (2013.01); *C23C 8/34* (2013.01)

(58) Field of Classification Search
CPC .... C22F 1/02; C22F 1/183; C22F 1/18; C23C 8/34; C23C 8/24; C23C 8/80; C23C 8/02
See application file for complete search history.

(56) References Cited

U.S. PATENT DOCUMENTS 6,093,259 A 7/2000 Watanabe et al.
2003/0118858 A1 6/2003 Kushida et al.

FOREIGN PATENT DOCUMENTS

JP 51-029963 A 3/1976
JP 60-075571 A 4/1985
(Continued)

OTHER PUBLICATIONS

Office Action dated Aug. 25, 2022 issued by the Chinese Patent Office in corresponding Chinese Application No. 201980038406.X.
(Continued)

*Primary Examiner* — Anthony M Liang
*Assistant Examiner* — Danny N Kang
(74) *Attorney, Agent, or Firm* — Sughrue Mion, PLLC

(57) ABSTRACT

A method for manufacturing a golden member includes a first heating step and a second heating step. The first heating step is a step of heating, in the atmosphere of mixed gas including nitrogen gas and water vapor, a raw material member including titanium or a titanium alloy at 670° C. or higher and 730° C. or lower for 150 minutes or more and 200 minutes or less. The second heating step is a step of heating, in the atmosphere of nitrogen gas or in the atmosphere of mixed gas including nitrogen gas and inert gas, the raw material member passing through the first heating step at 670° C. or higher and 730° C. or lower for 30 minutes or more and 120 minutes or less so as to obtain a golden member including titanium or a titanium alloy.

7 Claims, 8 Drawing Sheets

(56) References Cited

FOREIGN PATENT DOCUMENTS

| | | | | | |
|---|---|---|---|---|---|
| JP | 9-263929 | A | | 10/1997 | |
| JP | 11-43760 | A | | 2/1999 | |
| JP | 2001-081544 | A | | 3/2001 | |
| JP | 2001-301400 | A | | 10/2001 | |
| JP | 2001301400 | A | * | 10/2001 | ..... A47G 21/00 |
| JP | 3958838 | B2 | * | 8/2007 | ..... A44C 5/00 |

OTHER PUBLICATIONS

Notice of Reasons for Refusal dated Jun. 7, 2022 from the Japanese Patent Office in Japanese Application No. 2020-530004.
International Search Report for PCT/JP2019/017754 dated, Jul. 23, 2019 (PCT/ISA/210).

* cited by examiner

METHOD FOR MANUFACTURING GOLDEN MEMBER AND GOLDEN MEMBER

CROSS REFERENCE TO RELATED APPLICATIONS

This application is a National Stage of International Application No. PCT/JP2019/017754 filed Apr. 25, 2019, claiming priority based on Japanese Patent Application No. 2018-131394 filed Jul. 11, 2018.

FIELD

The present invention relates to a method for manufacturing a golden member and the golden member.

BACKGROUND

Patent Literature 1 discloses a wristwatch case the surface of which is formed of a nitride layer obtained by nitriding titanium or a titanium alloy in the temperature range of a β transformation point or below. Patent Literature 2 discloses external parts for a timepiece having a golden crystal pattern obtained by heating titanium or a titanium alloy in a high pressure vessel of a nitrogen gas atmosphere to a transformation point or above and pressurizing the titanium or the titanium alloy.

CITATION LIST

Patent Literature

Patent Literature 1: Japanese Patent Application Laid-open No. S51-29963

Patent Literature 2: Japanese Patent Application Laid-open No. S60-75571

SUMMARY

Technical Problem

However, the wristwatch case disclosed in Patent Literature 1 and the external parts for a timepiece disclosed in Patent Literature 2 showed dark golden color.

In this regard, an object of the present invention is to provide a method for manufacturing a golden member showing pale golden color.

Solution to Problem

A method for manufacturing a golden member according to the present invention includes a first heating step of heating, in the atmosphere of mixed gas including nitrogen gas and water vapor, a raw material member including titanium or a titanium alloy at 670° C. or higher and 730° C. or lower for 150 minutes or more and 200 minutes or less, and a second heating step of heating, in the atmosphere of nitrogen gas or in the atmosphere of mixed gas including nitrogen gas and inert gas, the raw material member passing through the first heating step at 670° C. or higher and 730° C. or lower for 30 minutes or more and 120 minutes or less so as to obtain a golden member including titanium or a titanium alloy.

Advantageous Effects of Invention

A method for manufacturing a golden member according to the present invention can provide a golden member showing pale golden color.

DESCRIPTION OF EMBODIMENT

An embodiment for implementing the present invention will now be described in detail. It should be noted that contents described in the embodiment below are not intended to limit the present invention. Components described below include components that can be easily thought of by the skilled person or substantially like components. Furthermore, configurations described below can be combined as appropriate. Various omissions, substitutions, or changes of the configurations may be made without departing from the spirit of the present invention.

Method for Manufacturing Golden Member According to Embodiment

Figure 1:
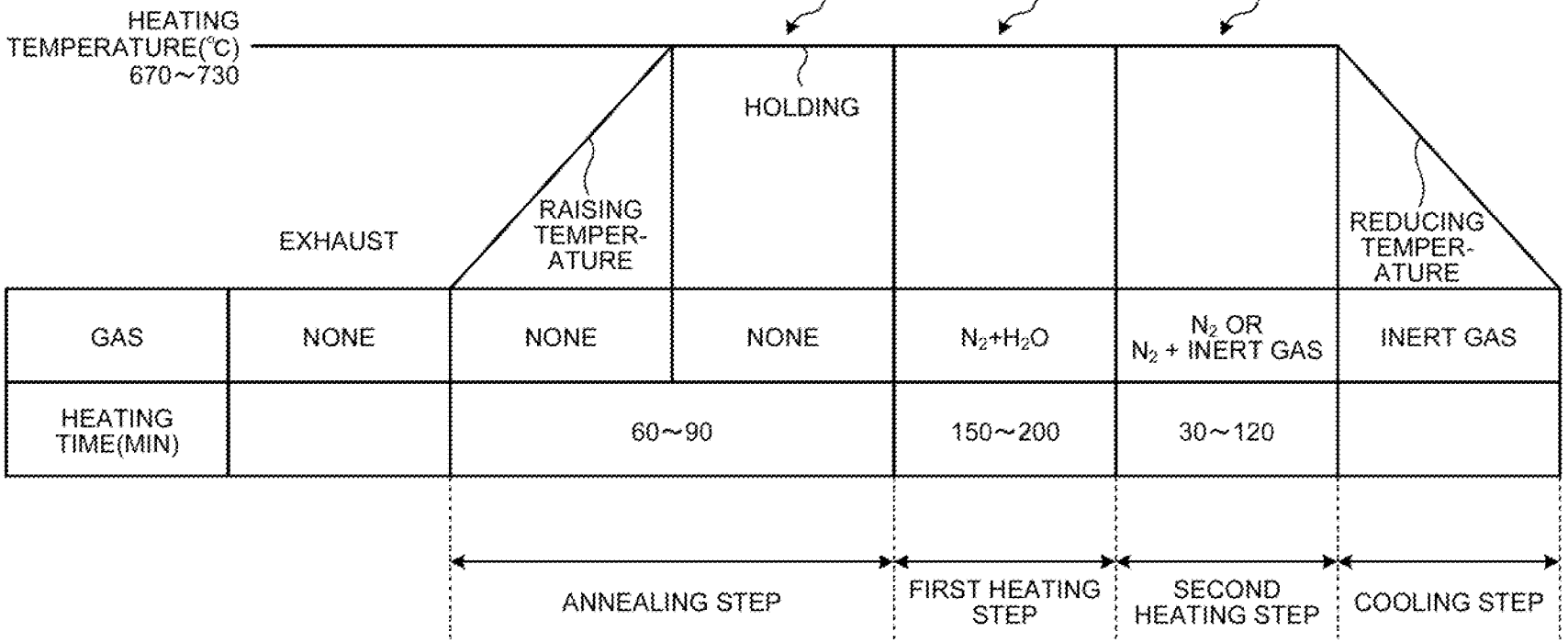
FIG. 1 is a view illustrating a method for manufacturing a golden member in accordance with an embodiment.

FIG. 1 is a view illustrating a method for manufacturing a golden member in accordance with the embodiment. As illustrated in FIG. 1, the method for manufacturing a golden member according to the embodiment includes an annealing step, and first and second heating steps. Generally, the method for manufacturing a golden member according to the embodiment further includes a cooling step.

In the method for manufacturing a golden member according to the embodiment, a raw material member including titanium or a titanium alloy is used. Specifically, the raw material member is formed of titanium or a titanium alloy.

In the titanium described above, for example, the content of titanium is 99% by mass or more. Specifically, examples of the titanium include industrial pure titanium corresponding to Japanese Industrial Standards (JIS) class 1, JIS class 2, JIS class 3 or JIS class 4. In the titanium alloy described above, the content of titanium is 80% by mass or more and less than 99% by mass. Specifically, examples of the titanium alloy include a titanium-aluminum (Ti—Al) alloy, a titanium-vanadium (Ti—V) alloy, a titanium-aluminum-vanadium (Ti—Al—V) alloy (for example, 64 alloy (Al: 6% by mass, V: 4% by mass)), a titanium-molybdenum (Ti—Mo) alloy, a titanium-manganese (Ti—Mn) alloy, a titanium-tin (Ti—Sn) alloy, and a titanium-iron (Ti—Fe) alloy.

In the method for manufacturing a golden member according to the embodiment, it is considered that nitrogen atoms and/or oxygen atoms are solid-dissolved from a surface of titanium or a titanium alloy forming a raw material member and are diffused in a depth direction of the titanium or the titanium alloy through the first and second heating steps. In this manner, in the manufacturing method according to the embodiment, solid solution layers of the nitrogen atoms and/or the oxygen atoms are formed on the surface of the titanium or the titanium alloy. Because the solid solution layers are formed, it is considered that a golden member shows pale golden color and also has improved hardness. In order to obtain the golden member showing pale golden color, hard films can be laminated on the surface of the titanium or the titanium alloy. However, the manufacturing method according to the embodiment can implement evenly and uniformly pale golden color as compared with the case where the hard films are laminated.

Figure 2:
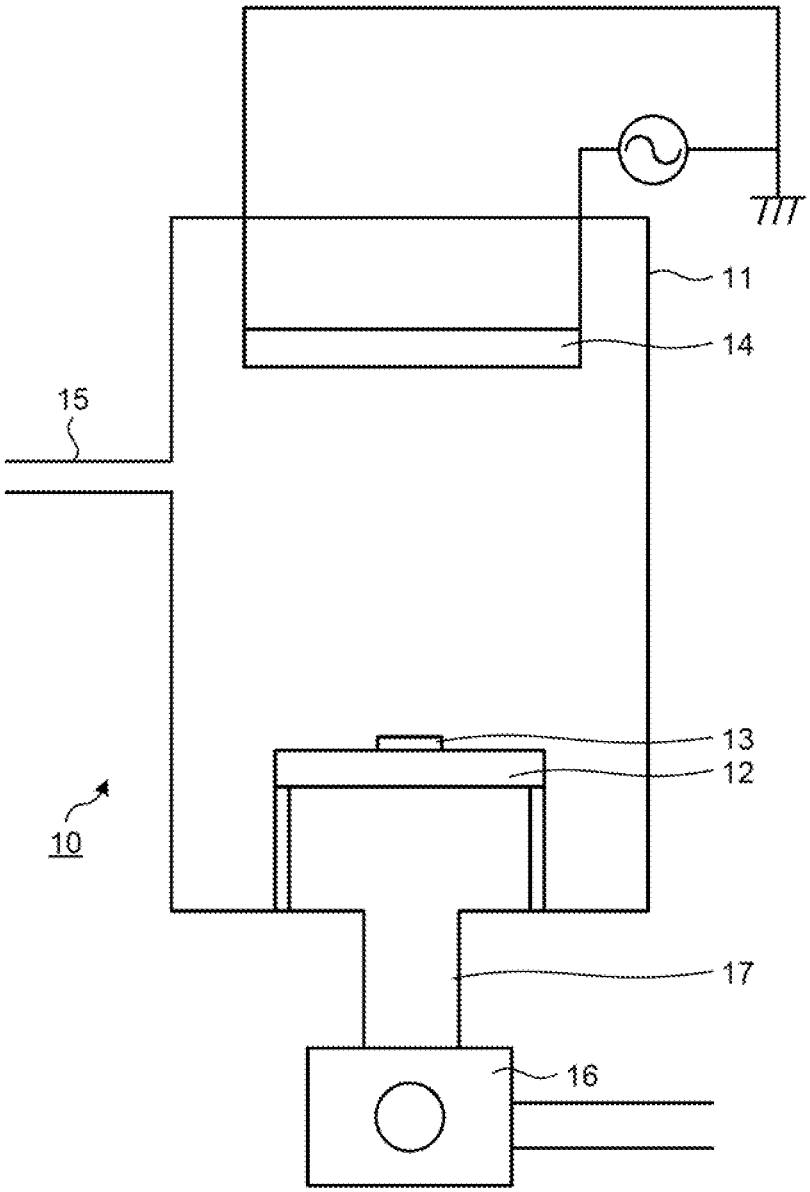
FIG. 2 is a view illustrating an example of a device used for the method for manufacturing a golden member in accordance with the embodiment.

In the manufacturing method according to the embodiment, a publicly known device can be used for performing the steps described above. FIG. 2 is a view illustrating an example of a device used for the method for manufacturing a golden member in accordance with the embodiment. A device 10 includes a vacuum chamber 11. The vacuum chamber 11 is provided with a support base 12, and a raw material member 13 is disposed on the support base 12 when the steps described above are performed. The vacuum chamber 11 is provided with a heater 14, and the heater 14 heats the raw material member 13. The vacuum chamber 11 is also provided with a gas inlet 15, a vacuum pump 16, a gas exhaust outlet 17, and the like, by which an atmosphere is controlled when the raw material member 13 is heated.

At the annealing step, the raw material member 13 is heated at a heating temperature (Ta) of 670° C. or higher and 730° C. or lower under reduced pressure (FIG. 1). Specifically, the raw material member 13 is disposed on the support base 12 in the vacuum chamber 11. Subsequently, exhaust is performed from the gas exhaust outlet 17 by the vacuum pump 16 so as to reduce the pressure in the vacuum chamber 11. After the pressure reduction, the heater 14 heats the raw material member 13 at the heating temperature (Ta) (FIG. 2). This kind of annealing step can reduce processing strain of titanium or a titanium alloy forming a raw material member. Performing the annealing step can provide solid solution layers each having a preferable thickness and having atoms of a preferable amount solid-dissolved therein at the first and second heating steps. Thus, an obtained golden member shows pale golden color and is also excellent in hardness.

The annealing step is preferably performed under reduced pressure of $1.0\times10^{-5}$ Pa or more and $1.0\times10^{-3}$ Pa or less. The annealing step can be performed without using inert gas.

More specifically, at the annealing step, the raw material member 13 is heated by raising a temperature from an ambient temperature (for example 25° C.) to the heating temperature (Ta). Subsequently, the raw material member 13 is held at the heating temperature (Ta) for a predetermined time and is further heated. Holding the raw material member at the heating temperature (Ta) for a predetermined time can uniformize a temperature of the raw material member and can further reduce processing strain.

The total of a time required for raising a temperature from an ambient temperature to the heating temperature (Ta) and a time for holding the raw material member 13 at the heating temperature (Ta) is preferably 60 minutes or more and 90 minutes or less.

At the first heating step, a raw material member passing through the annealing step is, in the atmosphere of mixed gas including nitrogen gas and water vapor, heated at a heating temperature (T1) of 670° C. or higher and 730° C. or lower for a heating time (t1) of 150 minutes or more and 200 minutes or less (FIG. 1). Specifically, the mixed gas is introduced from the gas inlet 15 into the vacuum chamber 11. While the mixed gas is introduced, the heater 14 heats the raw material member 13 at the heating temperature (T1) for the heating time (t1) (FIG. 2). Performing the first heating step with the conditions described above can provide solid solution layers each having a preferable thickness and having atoms of a preferable amount solid-dissolved therein. Thus, an obtained golden member shows pale golden color and is also excellent in hardness.

In the atmosphere of mixed gas, a partial pressure ratio of water vapor (water molecule) ($[H_2O]/([H_2O]+[N_2])$) is preferably 1% or more and 3% or less. When the partial pressure ratio is in the range described above, pale golden color can be provided and hardness can be suitably improved.

At the first heating step, mixed gas is preferably introduced from the gas inlet 15 into the vacuum chamber 11 with a flow rate of 1,500 standard cubic centimeter per minute (sccm) or more and 3,000 sccm or less. In the present specification, sccm represents a gas flow rate converted to a value at one atmospheric pressure and at 0° C. It is preferable that exhaust be performed from the gas exhaust outlet 17 by the vacuum pump 16 and pressure in the vacuum chamber 11 be adjusted to 10 Pa or more and 30 Pa or less while the mixed gas is introduced.

At the first heating step, a partial pressure ratio of water vapor (water molecule), and a flow rate and pressure of mixed gas may each be kept constant in the range described above and be changed in the range.

The heating temperature (T1) at the first heating step may be the same as the heating temperature (Ta) at the annealing step, and may be different if the heating temperature (T1) is in the temperature range described above. The heating temperature (T1) at the first heating step may be kept constant in the temperature range and be changed in the temperature range. The heating temperature (T1) is preferably 700° C. or lower in order to reduce roughness of a surface of titanium or a titanium alloy.

At the second heating step, a raw material member passing through the first heating step is, in the atmosphere of nitrogen gas or in the atmosphere of mixed gas including nitrogen gas and inert gas, heated at a heating temperature (T2) of 670° C. or higher and 730° C. or lower for a heating time (t2) of 30 minutes or more and 120 minutes or less (FIG. 1). Specifically, the nitrogen gas or the mixed gas is introduced from the gas inlet 15 into the vacuum chamber 11. While the nitrogen gas or the mixed gas is introduced, the heater 14 heats the raw material member 13 at the heating temperature (T2) for the heating time (t2) (FIG. 2). In this manner, a golden member including titanium or a titanium alloy can be obtained. Performing the second heating step with the conditions described above can provide solid solution layers having a preferable thickness and having atoms of a preferable amount solid-dissolved therein. Thus, the obtained golden member shows pale golden color and is also excellent in hardness.

When the second heating step is performed in the atmosphere of mixed gas, as inert gas included in the mixed gas, helium gas and argon gas are preferably used and the helium gas is more preferably used. The helium gas is more easily heated than the argon gas is and is unlikely to lower a temperature of a raw material member when the mixed gas is introduced.

When the second heating step is performed in the atmosphere of mixed gas, a partial pressure ratio of nitrogen gas ($[N_2]/([\text{inert gas}]+[N_2])$) is preferably 5% or more and 25% or less. When the partial pressure ratio is in the range described above, pale golden color can be provided and hardness can be suitably improved.

When the second heating step is performed in the atmosphere of nitrogen gas, the nitrogen gas is preferably introduced from the gas inlet 15 into the vacuum chamber 11 with a flow rate of 1,500 sccm or more and 3,000 sccm or less. It is preferable that exhaust be performed from the gas exhaust outlet 17 by the vacuum pump 16 and pressure in the vacuum chamber 11 be adjusted to 10 Pa or more and 30 Pa or less while the nitrogen gas is introduced.

When the second heating step is performed in the atmosphere of mixed gas, the mixed gas is preferably introduced from the gas inlet 15 into the vacuum chamber 11 with a flow rate of 1,500 sccm or more and 3,000 sccm or less. It is preferable that exhaust be performed from the gas exhaust outlet 17 by the vacuum pump 16 and pressure in the vacuum chamber 11 be adjusted to 10 Pa or more and 30 Pa or less while the mixed gas is introduced.

At the second heating step, a partial pressure ratio of nitrogen gas included in mixed gas, and a flow rate and pressure of the nitrogen gas or the mixed gas may each be kept constant in the range described above and be changed in the range.

The heating temperature (T2) at the second heating step may be the same as the heating temperature (T1) at the first heating step, and may be different if the heating temperature (T2) is in the temperature range described above. The heating temperature (T2) at the second heating step may be kept constant in the temperature range and be changed in the temperature range.

At the cooling step, the golden member obtained at the second heating step is, in the atmosphere of inert gas, cooled by reducing a temperature to an ambient temperature (for example 25) ° C. or higher and a temperature (Tc) of 150° C. or lower (FIG. 1). Specifically, the golden member is cooled while the inert gas is introduced from the gas inlet 15 into the vacuum chamber 11 (FIG. 2).

As inert gas, helium gas and argon gas are preferably used.

At the cooling step, inert gas is preferably introduced from the gas inlet 15 into the vacuum chamber 11 with a flow rate of 3,000 sccm or more and 10,000 sccm or less. Exhaust may be performed from the gas exhaust outlet 17 by the vacuum pump 16 and pressure in the vacuum chamber 11 may be adjusted to 10 Pa or more and 30 Pa or less while the inert gas is introduced. The cooling step may be performed without exhausting the vacuum chamber 11 in vacuum. At the cooling step, a flow rate and pressure of the inert gas may each be kept constant in the range described above and be changed in the range.

When the temperature (Tc) is higher than an ambient temperature, pressure in the vacuum chamber 11 can be returned to atmospheric pressure after a golden member is cooled to the temperature (Tc) and the golden member can be further cooled to the ambient temperature.

Figure 3:
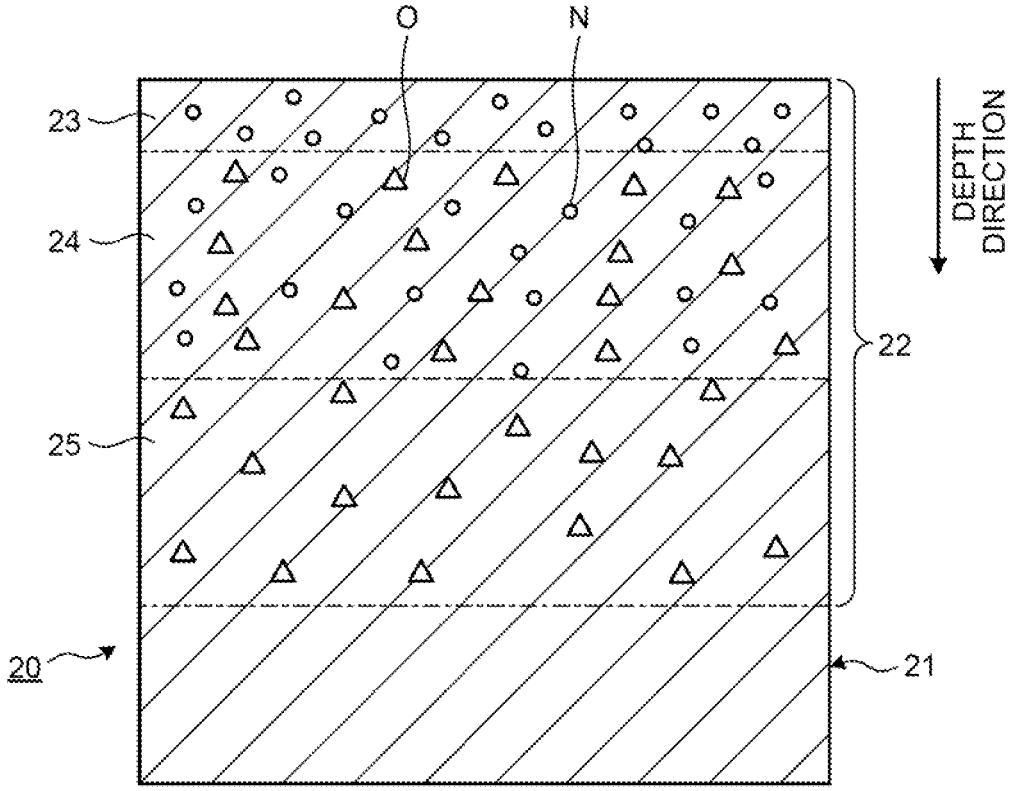
FIG. 3 is a view illustrating a golden member that is obtained by the method for manufacturing a golden member in accordance with the embodiment.

FIG. 3 is a view illustrating a golden member that is obtained by the method for manufacturing a golden member in accordance with the embodiment. Specifically, FIG. 3 is a schematic view illustrating the cross-sectional configuration of the golden member. It is considered that a golden member 20 obtained by the manufacturing method according to the embodiment includes solid solution layers 22 from a surface of titanium or a titanium alloy 21 in a depth direction. Specifically, the golden member 20 includes a second solid solution layer 23, a first solid solution layer 24, and a third solid solution layer 25 in this order as the solid solution layers 22 from the surface of the golden member 20 in the depth direction.

The first solid solution layer 24 is formed in the titanium or the titanium alloy 21 by solid solution of nitrogen atoms N and oxygen atoms O derived from nitrogen gas and water vapor used at the first heating step, respectively. The second solid solution layer 23 is formed in the titanium or the titanium alloy 21 by solid solution of, mainly, nitrogen atoms N derived from nitrogen gas used at the second heating step. In the second solid solution layer 23, partially, the nitrogen atoms N derived from the nitrogen gas used at the first heating step are also solid-dissolved. The third solid solution layer 25 is formed in the titanium or the titanium alloy 21 by solid solution of the oxygen atoms O derived from the water vapor used at the first heating step.

It is considered that the first solid solution layer 24, the second solid solution layer 23, and the third solid solution layer 25 are formed as follows. At the first heating step, the nitrogen atoms N and the oxygen atoms O derived from nitrogen gas and water vapor, respectively, are solid-dissolved from a surface of the titanium or the titanium alloy 21, and are diffused in a depth direction. Subsequently, at the second heating step, the nitrogen atoms N derived from nitrogen gas are solid-dissolved from the surface of the titanium or the titanium alloy 21, and are diffused in the depth direction. At this second heating step, the nitrogen atoms N and the oxygen atoms O that have been already solid-dissolved and diffused at the first heating step can be further diffused. In this manner, the first solid solution layer 24 in which the nitrogen atoms N and the oxygen atoms O are solid-dissolved is formed at a position deeper from the surface of the titanium or the titanium alloy 21, and the second solid solution layer 23 in which the nitrogen atoms N are solid-dissolved is formed near the surface. In addition, at the second heating step, out of the atoms that have been already solid-dissolved and diffused at the first heating step, the oxygen atoms O can be diffused deeper than the nitrogen atoms N. Thus, the third solid solution layer 25 in which the oxygen atoms O are solid-dissolved is formed on a position deeper than that of the first solid solution layer 24.

In this manner, in the golden member 20 obtained by the manufacturing method according to the embodiment, the first solid solution layer 24 and the second solid solution layer 23 are formed. Thus, it is considered that the golden member 20 shows pale golden color and also has improved hardness. In addition, because the third solid solution layer 25 is formed, it is considered that the golden member 20 also has improved impact resistance.

Because it is considered that the solid solution layers 22 are formed by solid-dissolution and diffusion described above, it is considered that concentration of solid-dissolved atoms with respect to a depth direction is gradually changed. In other words, it is considered that the concentration of the solid-dissolved atoms with respect to the depth direction is gradually reduced.

In each of the first solid solution layer 24, the second solid solution layer 23, and the third solid solution layer 25, a thickness in a depth direction and an amount of solid-dissolved atoms can be checked with, for example, glow discharge optical emission spectrometry (GDS).

At the first heating step, the heating time (t1) is a time for solid solution of nitrogen atoms and oxygen atoms from a surface of titanium or a titanium alloy. When the heating time (t1) is too short, there is concern that the sufficient thickness of the first solid solution layer and the second solid solution layer for improving hardness cannot be obtained. When the heating time (t1) is too long, there is concern that a crystal gain boundary of titanium is enlarged and a mirror surface cannot be obtained.

At the second heating step, the heating time (t2) is a time for further diffusing nitrogen atoms and oxygen atoms that have been solid-dissolved from a surface of titanium or a titanium alloy. The heating time (t2) is also a time for substituting and exhausting $H_2O$ in a vacuum chamber and forming a colored layer of titanium nitride (TiN) on the surface of the titanium or the titanium alloy. Thus, when the heating time (t2) is too short, there is concern that the sufficient thickness of the first solid solution layer and the second solid solution layer for improving hardness cannot be obtained. In addition, substitution of $H_2O$ becomes insufficient and the insufficient substitution can be uncertainties upon next processing. In other words, there is concern that target color and hardness cannot be obtained. When the heating time (t2) is too long, there is concern that the second heating step becomes useless processing because a significant change is not seen in color and hardness.

The golden member obtained by the manufacturing method according to the embodiment has, for example, in the Commission Internationale de l'Éclairage (CIE) Lab color space display system, an L* value satisfying $65<L^*\leq 80$, an a* value satisfying $-1.0\leq a^*\leq 2.2$, and a b* value satisfying $8.0\leq b^*\leq 21.5$. When the L* value, the a* value, and the b* value satisfy the range described above, the golden member shows pale golden color. From a viewpoint of more preferable pale golden color, the L* value, the a* value, and the b* value preferably satisfy $65<L^*\leq 80$, $-1.0\leq a^*\leq 2.0$, and $8.0\leq b^*\leq 20.0$, respectively. More preferably, the L* value, the a* value, and the b* value satisfy $65<L^*\leq 80$, $-1.0\leq a^*\leq 2.0$, and $11.0\leq b^*\leq 18.0$, respectively.

At the second heating step, when the heating temperature (T2) is made higher, color, even in pale golden color, can be relatively turned dark. This is considered that the second solid solution layer is thicker as the heating temperature (T2) is made higher, and an amount of nitrogen atoms in the second solid solution layer is increased. At the second heating step, when the heating temperature (T2) is made lower, color, even in pale golden color, can be relatively turned light. This is considered that the second solid solution layer is thinner as the heating temperature (T2) is made lower, and an amount of nitrogen atoms in the second solid solution layer is decreased. In this manner, color can be adjusted with the heating temperature (T2).

The golden member obtained by the manufacturing method according to the embodiment has, on a surface on which the solid solution layers are formed, the Vickers hardness (HV) of, for example 650 or more. On the cross-sectional surface of the golden member, the HV is 800 or more and 1,200 or less, for example, in an area located at a depth of 5 μm from the surface (that is generally considered to correspond to the second solid solution layer 23). The HV is 450 or more and 700 or less, for example, in an area located at a depth of 10 μm from the surface (that is generally considered to correspond to the first solid solution layer 24).

The following describes a modification of the manufacturing method according to the embodiment. The shape of a raw material member including titanium or a titanium alloy is not particularly limited. The shape such as a plate shape can be selected depending on a product to which a golden member is applied. The raw material member may have the configuration where titanium or a titanium alloy is laminated on a surface of stainless steel and the like. In this case, titanium or a titanium alloy is preferably laminated thicker than formed solid solution layers.

At the annealing step described above, the raw material member is held at the heating temperature (Ta) for a predetermined time and is further heated. However, at the annealing step, the raw material member is not necessarily held at the heating temperature (Ta) for a predetermined time. Specifically, after the raw material member is heated by raising a temperature from an ambient temperature (for example 25° C.) to the heating temperature (Ta), the first heating step may be proceeded.

At the cooling step described above, a golden member obtained at the second heating step is, in the atmosphere of inert gas, cooled by reducing a temperature to the temperature (Tc). However, at the cooling step, the golden member obtained at the second heating step may be cooled to an ambient temperature in the atmosphere.

In the golden member obtained by the manufacturing method according to the embodiment, the first solid solution layer 24 and the second solid solution layer 23 only have to be formed and the third solid solution layer 25 is not necessarily formed.

Golden Member According to Embodiment

The golden member according to the embodiment is a golden member including titanium or a titanium alloy.

For example, as illustrated in FIG. 3, the golden member according to the embodiment is the golden member 20 that is obtained by the manufacturing method described above. The golden member 20 includes the second solid solution layer 23, the first solid solution layer 24, and the third solid solution layer 25 in this order as the solid solution layers 22 from a surface of the golden member in the depth direction. The first solid solution layer 24 is a layer where the nitrogen atoms N and the oxygen atoms O are solid-dissolved in the titanium or the titanium alloy 21. The second solid solution layer 23 is a layer where the nitrogen atoms N are solid-dissolved in the titanium or the titanium alloy 21. The third solid solution layer 25 is a layer where the oxygen atoms O are solid-dissolved in the titanium or the titanium alloy 21.

In this manner, in the golden member 20 according to the embodiment, the first solid solution layer 24 and the second solid solution layer 23 are formed. Thus, it is considered that the golden member 20 shows pale golden color and also has improved hardness. In addition, because the third solid solution layer 25 is formed, it is considered that the golden member 20 also has improved impact resistance.

In the solid solution layers 22, it is considered that concentration of solid-dissolved atoms in the depth direction is gradually changed. In other words, it is considered that the concentration of the solid-dissolved atoms in the depth direction is gradually lower.

In each of the first solid solution layer 24, the second solid solution layer 23, and the third solid solution layer 25, a thickness in the depth direction and an amount of solid-dissolved atoms can be checked with, for example, glow discharge optical emission spectrometry (GDS).

The golden member according to the embodiment has, for example, in the CIE Lab color space display system, an L* value satisfying $65<L^*\leq 80$, an a* value satisfying $-1.0\leq a^*\leq 2.2$, and a b* value satisfying $8.0\leq b^*\leq 21.5$. When the L* value, the a* value, and the b* value satisfy the range described above, the golden member shows pale golden color. From a viewpoint of more preferable pale golden color, the L* value, the a* value, and the b* value preferably satisfy $65<L^*\leq 80$, $-1.0\leq a^*\leq 2.0$, and $8.0\leq b^*\leq 20.0$, respectively. More preferably, the L* value, the a* value, and the b* value satisfy $65<L^*\leq 80$, $-1.0\leq a^*\leq 2.0$, and $11.0\leq b^*\leq 18.0$, respectively.

The golden member according to the embodiment has, on a surface on which the solid solution layers are formed, the HV of, for example, 650 or more. On a cross-sectional surface of the golden member, the HV is 800 or more and 1,200 or less, for example, in an area located at a depth of 5 μm from the surface (that is generally considered to correspond to the second solid solution layer 23). The HV is 450 or more and 700 or less, for example, in an area located at a depth of 10 μm from the surface (that is generally considered to correspond to the first solid solution layer 24).

The following describes a modification of the golden member according to the embodiment. The shape of the golden member including titanium or a titanium alloy is not particularly limited. The shape such as a plate shape can be selected depending on a product to which the golden member is applied. The golden member may have the configuration where titanium or a titanium alloy is laminated on a surface of stainless steel and the like. In this case, titanium or a titanium alloy is preferably laminated thicker than formed solid solution layers. The golden member according to the embodiment can be obtained by the manufacturing method described above, but a golden member obtained by the other manufacturing methods may be adopted if the golden member has the configuration described above. In the golden member according to the embodiment, the first solid solution layer 24 and the second solid solution layer 23 only have to be formed and the third solid solution layer 25 is not necessarily formed.

Products Including Golden Member According to Embodiment

Products including the golden member according to the embodiment are not particularly limited, but examples of the products include ornaments, cases, sporting goods, commodities, medical apparatuses, and tableware. More specifically, examples of the products include timepiece components used for wristwatches, wall clocks, bracket clocks, and the like, cases of cameras, portable devices (for example, cell-phones, smartphones, and tablets), and the like, and eyeglasses, heads or shafts of golf clubs, main bodies of dental drills, and cups.

As above, the present invention relates to the following [1] to [8].

[1] A method for manufacturing a golden member includes a first heating step of heating, in the atmosphere of mixed gas including nitrogen gas and water vapor, a raw material member including titanium or a titanium alloy at 670° C. or higher and 730° C. or lower for 150 minutes or more and 200 minutes or less, and a second heating step of heating, in the atmosphere of nitrogen gas or in the atmosphere of mixed gas including nitrogen gas and inert gas, the raw material member passing through the first heating step at 670° C. or higher and 730° C. or lower for 30 minutes or more and 120 minutes or less so as to obtain a golden member including titanium or a titanium alloy.

The golden member obtained by the manufacturing method shows pale golden color and also has improved hardness.

[2] The method for manufacturing a golden member according to [1] further includes the annealing step of heating the raw material member described above at 670° C. or higher and 730° C. or lower under reduced pressure, and the first heating step is a step of heating the raw material member passing through the annealing step.

In this manner, processing strain of the raw material member can be reduced.

[3] In the method for manufacturing a golden member according to [1] or [2], the golden member includes a second solid solution layer and a first solid solution layer in this order from a surface of the golden member in a depth direction. The first solid solution layer is formed in the titanium or the titanium alloy described above by solid solution of nitrogen atoms and oxygen atoms derived from nitrogen gas and water vapor used at the first heating step, respectively, and the second solid solution layer is formed in the titanium or the titanium alloy by solid solution of nitrogen atoms derived from nitrogen gas used at the second heating step.

Because the golden member includes the second solid solution layer and the first solid solution layer, the golden member shows pale golden color and also has improved hardness.

[4] In the method for manufacturing a golden member according to [3], the golden member further includes a third solid solution layer, and includes the second solid solution layer, the first solid solution layer, and the third solid solution layer in this order from a surface of the golden member in a depth direction. The third solid solution layer is formed in the titanium or the titanium alloy by solid solution of oxygen atoms derived from water vapor used at the first heating step.

Because the golden member includes the third solid solution layer, the golden member also has improved impact resistance.

[5] A golden member including titanium or a titanium alloy includes a second solid solution layer and a first solid solution layer in this order from a surface of the golden member in a depth direction. The first solid solution layer is a layer in which nitrogen atoms and oxygen atoms are solid-dissolved in the titanium or the titanium alloy, and the second solid solution layer is a layer in which nitrogen atoms are solid-dissolved in the titanium or the titanium alloy.

The golden member shows pale golden color and also has improved hardness.

[6] The golden member according to [5] further includes a third solid solution layer, and includes the second solid solution layer, the first solid solution layer, and the third solid solution layer in this order from a surface of the golden member in a depth direction. The third solid solution layer is a layer in which oxygen atoms are solid-dissolved in the titanium or the titanium alloy.

Because the golden member includes the third solid solution layer, the golden member also has improved impact resistance.

[7] The golden member according to [5] or [6] has, in the CIE Lab color space display system, an L* value satisfying $65<L^*\leq 80$, an a* value satisfying $-1.0\leq a^*\leq 2.2$, and a b* value satisfying $8.0\leq b^*\leq 21.5$.

The golden member shows pale golden color.

[8] The golden member according to any one of [5] to [7] has the HV of 650 or more.

The golden member also has improved hardness.

The present invention will be described based on examples more specifically, but the present invention is not limited to these examples.

EXAMPLES

Evaluation Method

Color was measured by a spectrophotometric colorimeter (Product name: CM-700d made by KONICA MINOLTA, INC.). The HV was tested with a load of 50 gf and a load holding time of 10 sec. by a microhardness tester (Product name: FM-7 made by FUTURE-TECH CORP.). The color and the HV were examined on a surface of the golden member on which solid solution layers are formed by applying the following heating steps (specifically, in FIG. 2, a surface corresponding to an upper surface of the raw material member 13 positioned toward the heater 14).

In addition, the HV was also tested on a cross-sectional surface of the golden member. Specifically, the test was conducted on the cross-sectional surface obtained by vertically cutting the surface on which the solid solution layers are formed at positions located at the depth of 5 μm, 10 μm, 15 μm, 20 μm, 25 μm, and 30 μm from the surface. In this case, the HV was tested with a load of 5 gf and a load holding time of 10 sec. by a microhardness tester (Product name: FM-7 made by FUTURE-TECH CORP.).

Example 1-1

A device illustrated in FIG. 2 was used. At the annealing step, a member of pure titanium (Ti) as the raw material member 13 was disposed on the support base 12 in the vacuum chamber 11. Subsequently, exhaust was performed from the gas exhaust outlet 17 by the vacuum pump 16 so as to reduce the pressure in the vacuum chamber 11 to $6.0\times10^{-4}$ Pa. Subsequently, the heater 14 heated the raw material member 13 by raising a temperature from an ambient temperature to the heating temperature (Ta=690° C.) for 40 minutes. Subsequently, the raw material member 13 was held at 690° C. (heating temperature (Ta)) for 20 minutes and was further heated.

Subsequently, the first heating step was performed on the raw material member 13 passing through the annealing step. Mixed gas was introduced from the gas inlet 15 into the vacuum chamber 11. A flow rate of $N_2$ was 1,770 sccm, and a flow rate of $H_2O$ was 25.58 sccm. In the mixed gas, a partial pressure ratio of water vapor (water molecule) was in the range described above. While the mixed gas was introduced, the heater 14 heated the raw material member 13 at 690° C. (heating temperature (T1)) for 180 minutes (heating time (t1)). In addition, exhaust was performed from the gas exhaust outlet 17 by the vacuum pump 16 and pressure in the vacuum chamber 11 was adjusted to 21.33 Pa while the mixed gas was introduced.

Subsequently, the second heating step was performed on the raw material member 13 passing through the first heating step. Nitrogen gas was introduced from the gas inlet 15 into the vacuum chamber 11. A flow rate of $N_2$ was 1,800 sccm. While the nitrogen gas was introduced, the heater 14 heated the raw material member 13 at 690° C. (heating temperature (T2)) for 60 minutes (heating time (t2)). In this manner, a golden member was obtained. In addition, exhaust was performed from the gas exhaust outlet 17 by the vacuum pump 16 and pressure in the vacuum chamber 11 was adjusted to 21.33 Pa while the nitrogen gas was introduced.

At the cooling step, the golden member obtained at the second heating step was cooled by reducing a temperature to 150° C. (temperature (Tc)) while helium gas was introduced from the gas inlet 15 into the vacuum chamber 11. A flow rate of the helium gas was 3,000 sccm. In addition, exhaust was performed from the gas exhaust outlet 17 by the vacuum pump 16 and pressure in the vacuum chamber 11 was adjusted to 21.33 Pa while the helium gas was introduced. After the golden member was cooled to 150° C. (temperature (Tc)), pressure in the vacuum chamber 11 was returned to atmospheric pressure and the golden member was further cooled to an ambient temperature. In this manner, the golden member was produced.

Examples 1-2 to 1-4

In examples 1-2 to 1-4, golden members were produced in the same way as the example 1-1 except that the heating temperatures (Ta, T1, and T2) were changed to 700° C., 710° C., and 720° C., respectively.

Table 1 shows the results of evaluating color and hardness of the golden members obtained in the examples 1-1 to 1-4.

Table 1

TABLE 1

| Example | Heating temperature (T1, T2) (° C.) | Hardness (HV) | Color L* | a* | b* |
|---|---|---|---|---|---|
| 1-1 | 690 | 666.3 | 73.98 | 1.01 | 13.83 |
| 1-2 | 700 | 724.6 | 74.20 | 1.28 | 16.72 |
| 1-3 | 710 | 759.3 | 75.23 | 1.03 | 15.75 |
| 1-4 | 720 | 781.8 | 75.77 | 0.88 | 14.14 |

Figure 4:
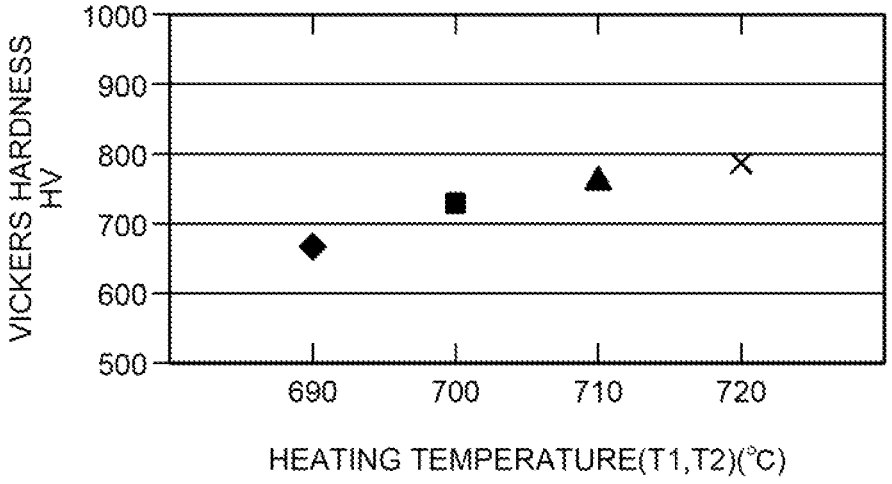
FIG. 4 is a view illustrating a change in hardness with respect to heating temperatures T1 and T2 in examples 1-1 to 1-4.
Figure 5:
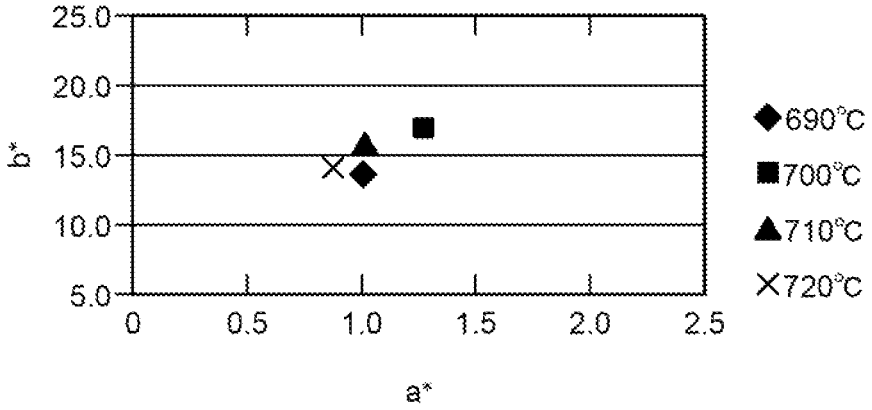
FIG. 5 is a view illustrating a change in color with respect to the heating temperatures T1 and T2 in the examples 1-1 to 1-4.

FIG. 4 is a view illustrating a change in hardness with respect to the heating temperatures T1 and T2 in the examples 1-1 to 1-4. FIG. 5 is a view illustrating a change in color with respect to the heating temperatures T1 and T2 in the examples 1-1 to 1-4.

Example 2-1

In an example 2-1, a golden member was produced in the same way as the example 1-1 except that the heating time (t2) was changed to 30 minutes.

Example 2-2

In an example 2-2, a golden member was produced in the same way as the example 2-1 except that the heating time (t2) was changed to 90 minutes.

Table 2 shows the results of evaluating color and hardness of the golden members obtained in the examples 2-1, 1-1, and 2-2.

Table 2

TABLE 2

| Example | Heating time (t2) (min) | Hardness (HV) | Color L* | a* | b* |
|---|---|---|---|---|---|
| 2-1 | 30 | 667.1 | 74.83 | 1.17 | 16.04 |
| 1-1 | 60 | 666.3 | 73.98 | 1.01 | 13.83 |
| 2-2 | 90 | 683.8 | 74.46 | 1.23 | 16.02 |

Figure 6:
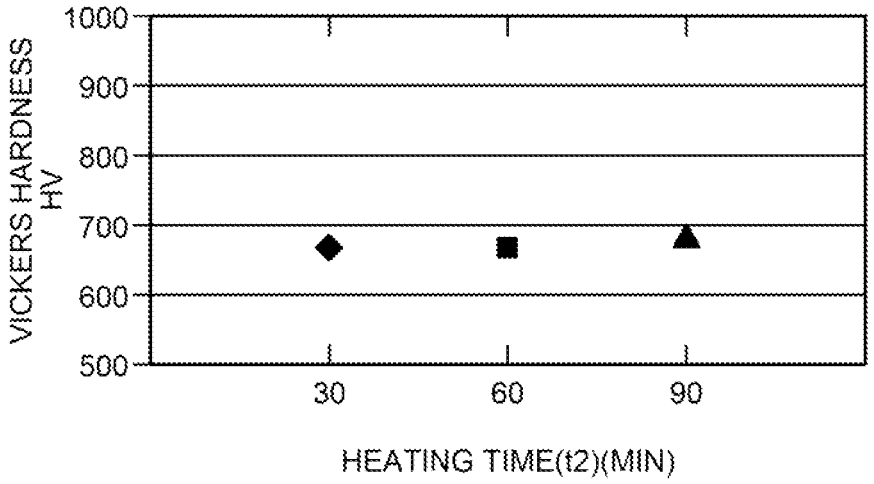
FIG. 6 is a view illustrating a change in hardness with respect to a heating time t2 in an example 2-1, the example 1-1, and an example 2-2.
Figure 7:
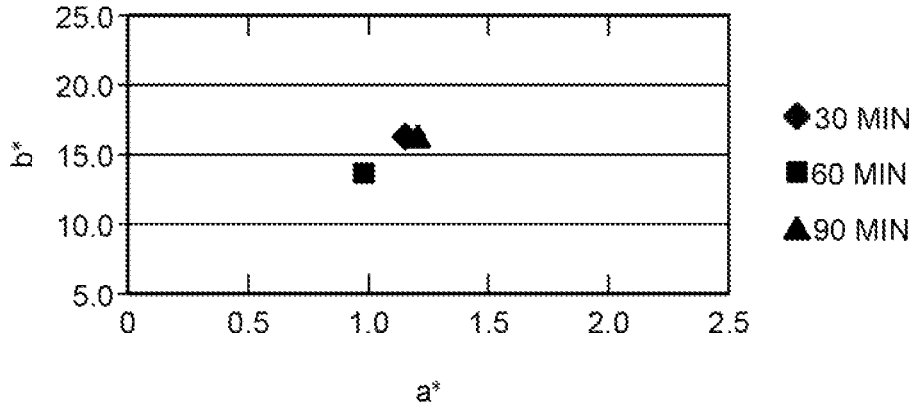
FIG. 7 is a view illustrating a change in color with respect to the heating time t2 in the examples 2-1, 1-1, and 2-2.

FIG. 6 is a view illustrating a change in hardness with respect to the heating time t2 in the examples 2-1, 1-1, and 2-2. FIG. 7 is a view illustrating a change in color with respect to the heating time t2 in the examples 2-1, 1-1, and 2-2.

Example 3-1

A device illustrated in FIG. 2 was used. At the annealing step, a member of pure Ti as the raw material member 13 was disposed on the support base 12 in the vacuum chamber 11. Subsequently, exhaust was performed from the gas exhaust outlet 17 by the vacuum pump 16 so as to reduce the pressure in the vacuum chamber 11 to $6.0\times10^{-4}$ Pa. Subsequently, the heater 14 heated the raw material member 13 by raising a temperature from an ambient temperature to the heating temperature (Ta=700° C.) for 40 minutes. Subsequently, the raw material member 13 was held at 700° C. (heating temperature (Ta)) for 20 minutes and was further heated.

Subsequently, the first heating step was performed on the raw material member 13 passing through the annealing step. Mixed gas was introduced from the gas inlet 15 into the vacuum chamber 11. A flow rate of $N_2$ was 1,770 sccm, and a flow rate of $H_2O$ was 25.60 sccm. In the mixed gas, a partial pressure ratio of water vapor (water molecule) was in the range described above. While the mixed gas was introduced, the heater 14 heated the raw material member 13 at 700° C. (heating temperature (T1)) for 180 minutes (heating time (t1)). In addition, exhaust was performed from the gas exhaust outlet 17 by the vacuum pump 16 and pressure in the vacuum chamber 11 was adjusted to 19.99 Pa while the mixed gas was introduced.

Subsequently, the second heating step was performed on the raw material member 13 passing through the first heating step. Nitrogen gas was introduced from the gas inlet 15 into the vacuum chamber 11. A flow rate of $N_2$ was 1,800 sccm. While the nitrogen gas was introduced, the heater 14 heated the raw material member 13 at 700° C. (heating temperature (T2)) for 90 minutes (heating time (t2)). In this manner, a golden member was obtained. In addition, exhaust was performed from the gas exhaust outlet 17 by the vacuum pump 16 and pressure in the vacuum chamber 11 was adjusted to 19.99 Pa while the nitrogen gas was introduced.

At the cooling step, the golden member obtained at the second heating step was cooled by reducing a temperature to 150° C. (temperature (Tc)) while helium gas was introduced from the gas inlet 15 into the vacuum chamber 11. A flow rate of the helium gas was 3,000 sccm. In addition, exhaust was performed from the gas exhaust outlet 17 by the vacuum pump 16 and pressure in the vacuum chamber 11 was adjusted to 19.99 Pa while the helium gas was introduced. After the golden member was cooled to 150° C. (temperature (Tc)), pressure in the vacuum chamber 11 was returned to atmospheric pressure and the golden member was further cooled to an ambient temperature. In this manner, the golden member was produced.

Examples 3-2 and 3-3

In examples 3-2 and 3-3, golden members were produced in the same way as the example 3-1 except that pressure in the vacuum chamber 11 was changed to 21.33 Pa and 23.01 Pa, respectively.

Table 3 shows the results of evaluating color and hardness of the golden members obtained in the examples 3-1 to 3-3.

Table 3

TABLE 3

| Example | Degree of vacuum (Pa) | Hardness (HV) | Color L* | a* | b* |
|---|---|---|---|---|---|
| 3-1 | 19.99 | 737.0 | 74.60 | 1.15 | 16.37 |
| 3-2 | 21.33 | 731.8 | 78.33 | 0.65 | 13.52 |
| 3-3 | 23.01 | 756.8 | 75.11 | 1.06 | 15.94 |

Figure 8:
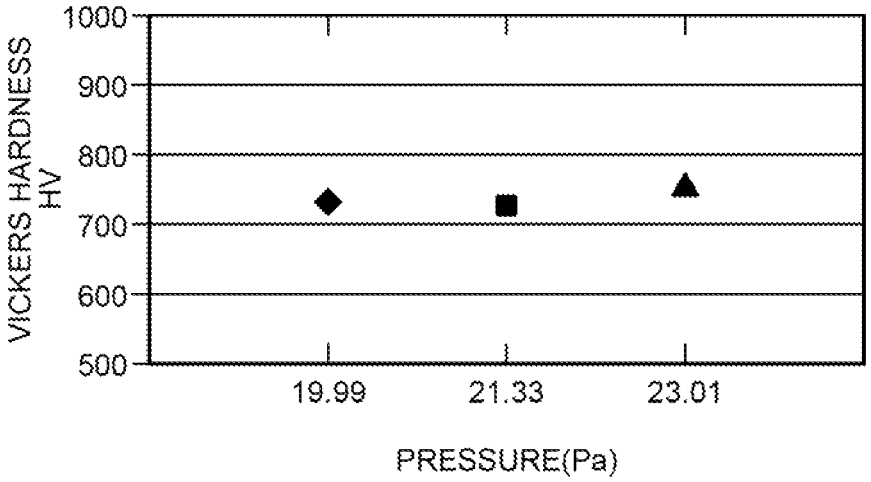
FIG. 8 is a view illustrating a change in hardness with respect to a degree of vacuum in examples 3-1 to 3-3.
Figure 9:
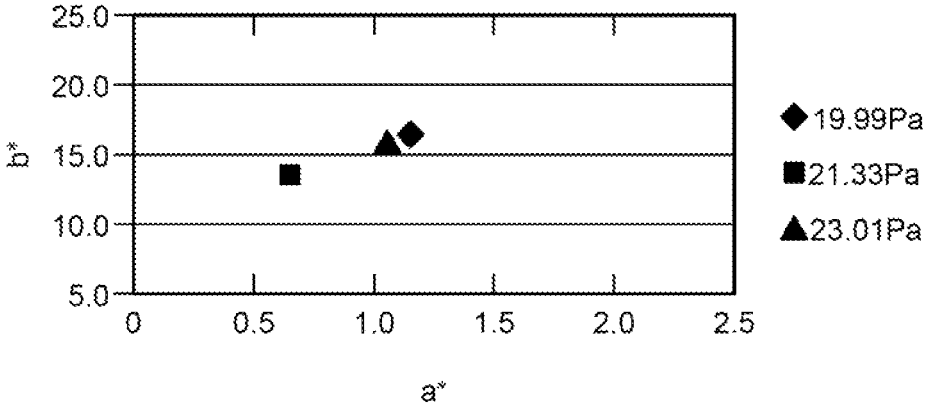
FIG. 9 is a view illustrating a change in color with respect to the degree of vacuum in the examples 3-1 to 3-3.

FIG. 8 is a view illustrating a change in hardness with respect to a degree of vacuum in the examples 3-1 to 3-3. FIG. 9 is a view illustrating a change in color with respect to the degree of vacuum in the examples 3-1 to 3-3.

Figure 12:
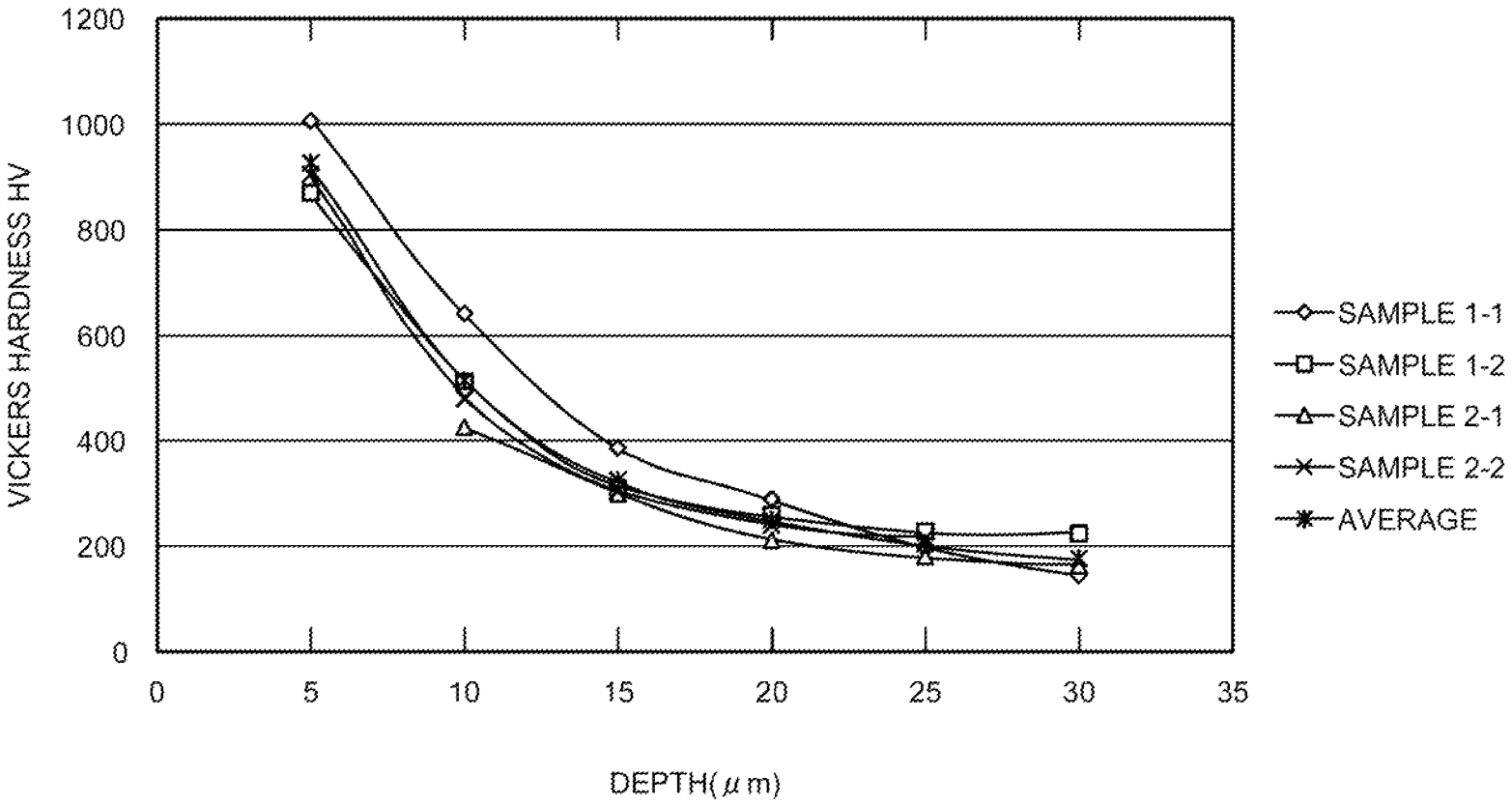
FIG. 12 is a view illustrating results of cross-sectional hardness measurement in the example 3-2.

FIG. 12 is a view illustrating the results of cross-sectional hardness measurement in the example 3-2. Tests were made on each of the two samples (samples 1 and 2) obtained in the example 3-2 at two positions. In FIG. 12, graphs of the samples 1-1 and 1-2 show the test results of the sample 1 at the two positions, and graphs of the samples 2-1 and 2-2 show the test results of the sample 2 at the two positions. FIG. 12 also shows a graph obtained by averaging the test results of the samples 1-1, 1-2, 2-1, and 2-2.

Example 4-1

In an example 4-1, a golden member was produced in the same way as the example 2-2 except that a member (Product name: KS-100 made by Kobe Steel, Ltd.) of a Ti alloy (iron (Fe) addition) was used as the raw material member 13.

Table 4 shows the results of evaluating color and hardness of the golden members obtained in the examples 1-1 and 4-1.

Table 4

TABLE 4

| Example | Raw material member | Hardness (HV) | Color L* | a* | b* |
|---|---|---|---|---|---|
| 1-1 | Pure Ti | 666.3 | 73.98 | 1.01 | 13.83 |
| 4-1 | KS-100 | 686.2 | 74.65 | 1.09 | 15.46 |

Figure 10:
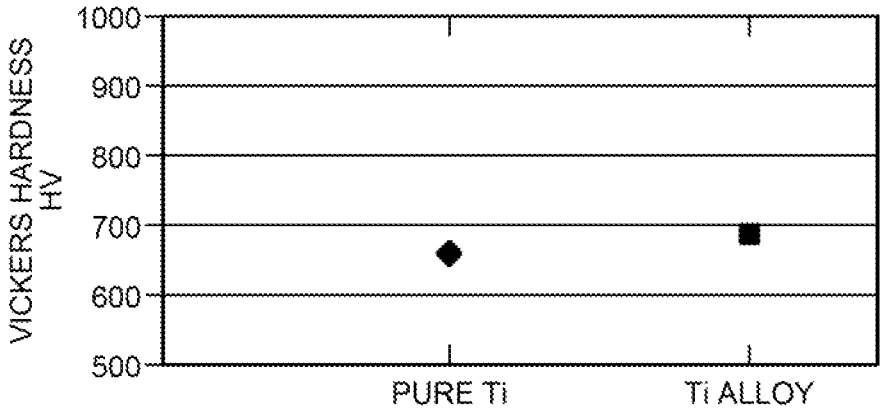
FIG. 10 is a view illustrating a change in hardness with respect to raw material members in the example 1-1 and an example 4-1.
Figure 11:
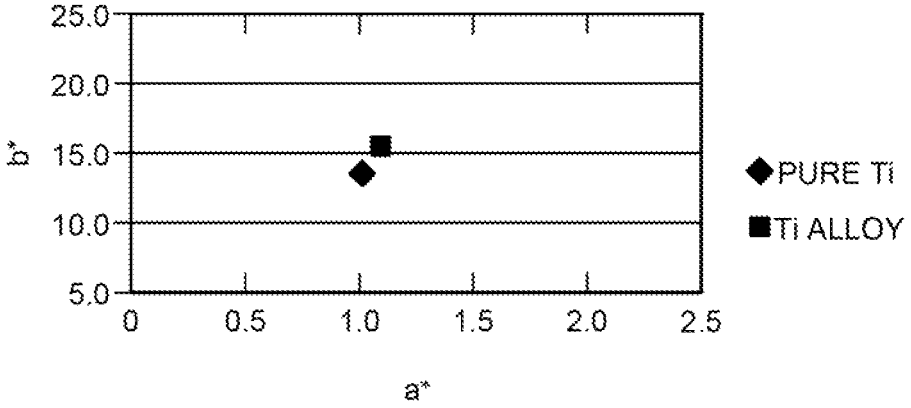
FIG. 11 is a view illustrating a change in color with respect to the raw material members in the examples 1-1 and 4-1.

FIG. 10 is a view illustrating a change in hardness with respect to raw material members in the examples 1-1 and 4-1. FIG. 11 is a view illustrating a change in color with respect to the raw material members in the examples 1-1 and 4-1. It is considered that a difference in results of pure Ti and a Ti alloy is generated because the Ti alloy is originally harder and easy polishing causes a surface state of the Ti alloy to be made better than that of the pure Ti.

Comparative Example 1-1

In a comparative example 1-1, a golden member was produced in the same way as the example 3-2 except that nitrogen gas (flow rate was 1,800 sccm) was used as substitute for mixed gas at the first heating step.

Table 5 shows the results of evaluating color and hardness of the golden member obtained in the comparative example 1-1.

Table 5

TABLE 5

| Comparative example | Flow rate of $H_2O$ (sccm) | Hardness (HV) | Color L* | a* | b* |
|---|---|---|---|---|---|
| 1-1 | 0 | 251.9 | 79.32 | 0.12 | 5.27 |

REFERENCE SIGNS LIST

10 DEVICE
11 VACUUM CHAMBER
12 SUPPORT BASE
13 RAW MATERIAL MEMBER
14 HEATER
15 GAS INLET
16 VACUUM PUMP
17 GAS EXHAUST OUTLET
20 GOLDEN MEMBER
21 TITANIUM OR TITANIUM ALLOY
22 SOLID SOLUTION LAYER
23 SECOND SOLID SOLUTION LAYER
24 FIRST SOLID SOLUTION LAYER
25 THIRD SOLID SOLUTION LAYER

The invention claimed is:

1. A golden member including titanium or a titanium alloy, wherein the golden member further includes a second solid solution layer and a first solid solution layer in this order from a surface of the golden member in a depth direction, the first solid solution layer is a layer in which nitrogen atoms and oxygen atoms are solid-dissolved in the titanium or the titanium alloy, and the second solid solution layer is a layer in which nitrogen atoms are solid-dissolved in the titanium or the titanium alloy.

2. The golden member according to claim 1, wherein the golden member includes a third solid solution layer, and includes the second solid solution layer, the first solid solution layer, and the third solid solution layer in this order from a surface of the golden member in a depth direction, and the third solid solution layer is a layer in which oxygen atoms are solid-dissolved in the titanium or the titanium alloy.

3. The golden member according to claim 1, wherein the golden member has, in the Commission Internationale de l'Éclairage (CIE) Lab color space display system, an L* value satisfying $65<L^*\leq 80$, an a* value satisfying $-1.0\leq a^*\leq 2.2$, and a b* value satisfying $8.0\leq b^*\leq 21.5$.

4. The golden member according to claim 2, wherein the golden member has, in the Commission Internationale de l'Éclairage (CIE) Lab color space display system, an L* value satisfying $65<L^*\leq 80$, an a* value satisfying $-1.0\leq a^*\leq 2.2$, and a b* value satisfying $8.0\leq b^*\leq 21.5$.

5. The golden member according to 14, wherein the golden member has the Vickers hardness (HV) of 650 or more.

6. The golden member according to claim 2, wherein the golden member has the Vickers hardness (HV) of 650 or more.

7. The golden member according to claim 3, wherein the golden member has the Vickers hardness (HV) of 650 or more.

* * * * *